US006263688B1

(12) United States Patent
Bedard

(10) Patent No.: US 6,263,688 B1
(45) Date of Patent: Jul. 24, 2001

(54) TRANSPORTABLE DISPLAY SYSTEM

(76) Inventor: Mark Bedard, 675 Anyon, Greenfield Park, Quebec (CA), J4V 2G1

( * ) Notice: Subject to any disclaimer, the term of this patent is extended or adjusted under 35 U.S.C. 154(b) by 0 days.

(21) Appl. No.: 09/418,694

(22) Filed: Oct. 15, 1999

Related U.S. Application Data

(63) Continuation-in-part of application No. 09/046,818, filed on Mar. 24, 1998, now abandoned.

(30) Foreign Application Priority Data

Jul. 14, 1997 (CA) ..... 2210305

(51) Int. Cl.[7] ..... A47F 3/04
(52) U.S. Cl. ..... 62/237; 62/255
(58) Field of Search ..... 62/246, 249, 255, 62/256, 237, 298

(56) References Cited

U.S. PATENT DOCUMENTS 2,007,690 * 7/1935 Nystrom ..... 62/237
2,187,859 * 1/1940 Killingstad ..... 62/237
2,336,125 * 12/1943 Preble ..... 62/237
2,538,382 * 1/1951 Reilly ..... 62/237
2,546,417 * 3/1951 Anglin ..... 62/255
2,914,927 * 12/1959 Corhanidis ..... 62/237
2,915,884 * 12/1959 Haushalter et al. ..... 62/256
3,491,548 * 1/1970 Christiansen ..... 62/255
4,361,014 * 11/1982 Plain ..... 62/237
4,671,411 * 6/1987 Rehrig et al. ..... 205/505
4,934,255 * 6/1990 McDonnell et al. ..... 62/237
5,265,921 * 11/1993 Nikitas et al. ..... 292/145
5,605,102 * 2/1997 Simpson ..... 108/51.1

* cited by examiner

*Primary Examiner*—William E. Tapolcal
(74) *Attorney, Agent, or Firm*—Eric Fincham

(57) ABSTRACT

A transportable refrigerated display system having a display unit and a refrigeration unit, the display unit having first and second side walls and an end wall, the display unit being placed adjacent a refrigeration unit end wall which has an upper air inlet and a lower air outlet whereby circulation means circulate cooled air from the refrigeration unit through the lower air outlet and receive air from the upper air inlet to circulate cool air under a pallet placed within the display unit.

11 Claims, 7 Drawing Sheets

TRANSPORTABLE DISPLAY SYSTEM

The present application is a continuation-in-part of application Ser. No. 09/046,818 filed Mar. 24, 1998,now abandoned

BACKGROUND OF THE INVENTION

The present invention relates to a refrigerated display system and more particularly, relates to a transportable refrigerated display system.

The use of refrigerated display systems is well known in the art and many such systems are known and commercially available. Generally, the systems are either of the fixed type wherein they remain in one position or of the knock down variety which may be moved from one location to another in the store or be set up in the store for a limited period of time. The present invention is directed to the latter type—one which may be easily set up and removed.

One such system is illustrated in U.S. Pat. No. 4,898,004. In this patent, the display system comprises a reusable refrigeration unit and a preferably disposable knock down storage and display unit which sits on the top of the refrigeration unit. The knock down unit includes duct openings corresponding to ducts of the refrigeration unit and an air plenum having ribs for forcing air to the insulated outer walls of the knock down unit. The outer walls include inwardly extending ribs for creating channels for the cool air to flow to the top.

A more permanent type of arrangement is shown in U.S. Pat. No. 4,161,868 which shows a refrigerated case having a front wall access for loading and unloading items for display. In this arrangement, baskets containing the items for display may be slid over the inner surface of the panel and into the well portion. The refrigerated air is circulated through a rear wall of the case and extends such that the air is discharged at the top of the rear wall.

An open fronted refrigerated display case is shown in U.S. Pat. No. 4,034,572 wherein the entire front portion is open to provide the consumer access to products which may be loaded on a cart through a rear opening in the display case. The cool refrigerated air is discharged in a downwardly extending curtain.

Often, it is desirable to have a refrigerated display case which may be easily set up and knocked down for temporary displays of products. Thus, a store or food manufacturer will often run a promotion for a limited period of time. The promotion may relate to special pricing and/or introduction of a product. Accordingly, it would be desirable to have a knock down display case which is not only readily set up and knocked down, but is also transportable from one location to another.

Frequently, the refrigerated display case is to be set up by a sales person or other representative of the food manufacturer. As such, it should be easily moved into position and should also be able to accept the product to be marketed. Usually, these products are provided on pallets and accordingly, it would be convenient to have an arrangement wherein the refrigerated display case can accept a pallet of the product to be displayed. None of the teachings in the prior art show such an arrangement.

SUMMARY OF THE INVENTION

It is an object of the present invention to provide a refrigerated display case which may be easily set up and knocked down by a single person.

It is a further object of the present invention to provide a refrigerated display case wherein the display case is designed to accept a pallet load of product.

It is a further object of the present invention to provide a transportable refrigerated display case.

According to one aspect of the present invention, there is provided a refrigerated display system which comprises a display unit and a refrigeration unit. The refrigeration unit comprises cooling means for cooling air, a refrigeration unit end wall which has an upper air inlet and a lower air outlet, and circulation means arranged to circulate cooled air from the cooling means through the lower air outlet and to receive air from the upper air inlet. The display unit comprises first and second side walls extending from the end wall of the refrigeration unit and with a display unit end wall extending between distal ends of the side walls such that the display unit end wall is opposite the refrigeration unit end wall. The arrangement is such that the cooled air will be circulated under a pallet placed within the display unit.

According to a further aspect of the present invention, there is provided, in combination, a refrigerated display system and a pallet having articles to be cooled placed thereon, the refrigerated display system comprising a display unit and a refrigeration unit, the refrigeration unit comprising cooling means for cooling air, a refrigeration unit end wall having an upper air inlet and a lower air outlet, circulation means arranged to circulate cooled air from the cooling means through the lower air outlet and to receive air from the upper air inlet, the display unit comprising first and second side walls extending from the end wall of the refrigeration unit, a display unit end wall extending between distal ends of the side walls, the display unit end wall being opposite the refrigeration unit end wall, the pallet being placed within the display unit, the arrangement being such that the cooled air will be circulated from the lower outlet under the pallet placed within the display unit.

The refrigerated display system of the present invention is transportable—i.e. it can be rapidly set up and knocked down to provide for temporary displays when required. Typically such a display may be during various promotions. The refrigerated display system can be set up in vacant aisle space and is particularly designed to receive a pallet of a product which is to be kept refrigerated while on display.

In order to provide for the above, the display system preferably has a display unit with one wall being moveable so as to permit the loading into the display case by a jigger truck of the loaded pallet. To this end, one of the walls may be moveable by means of an hinge arrangement.

As is conventional, wooden pallets provide for entry of the times of the jigger truck at opposed pallet ends. The pallet is loaded so as to permit the circulation of the cooled air underneath the pallet. When the air circulates underneath, it is permitted to pass through the openings in the pallet base and around the sides of the material on the pallet.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
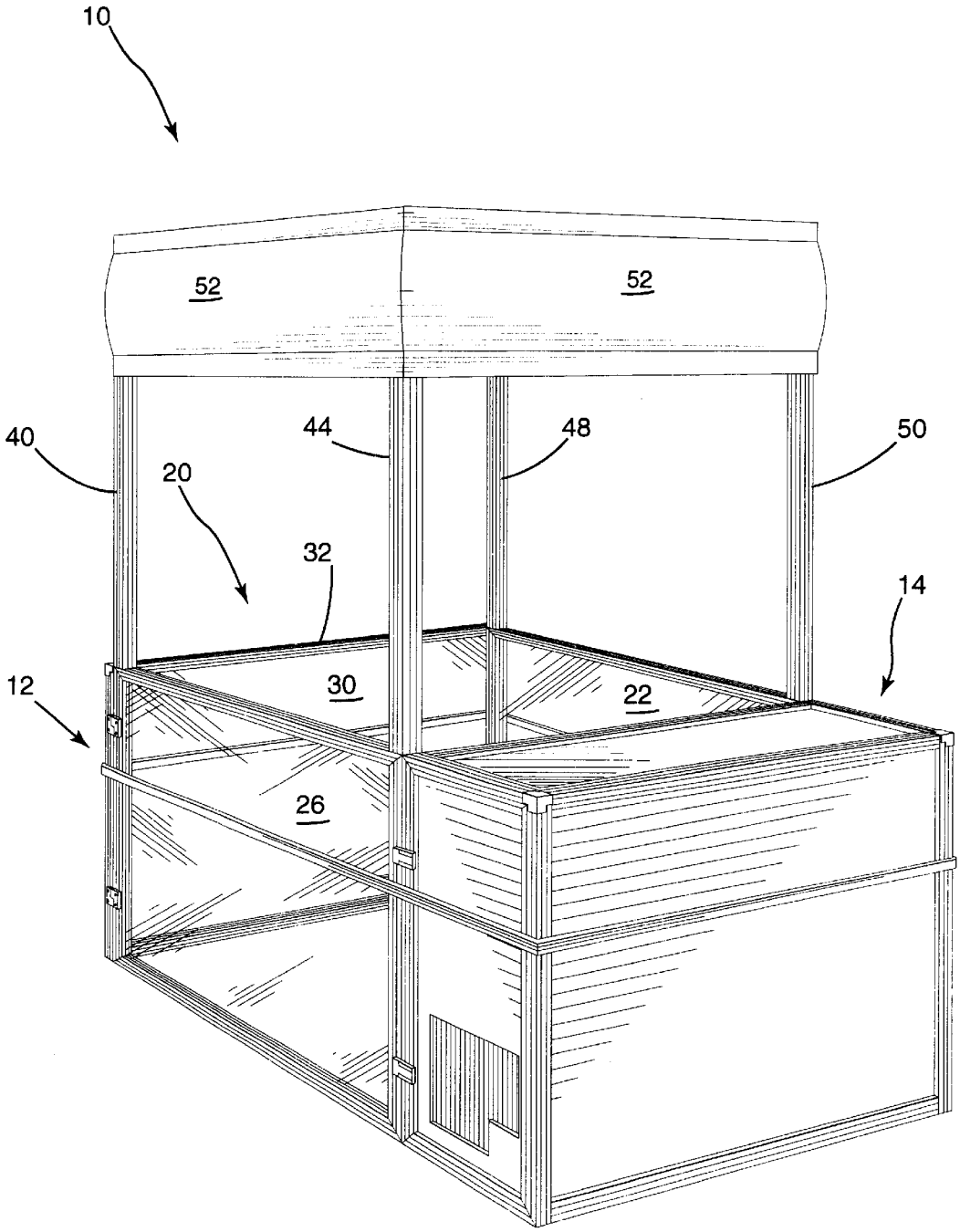
FIG. 1 is a perspective view of a refrigerated display unit according to the present invention.
Figure 2:
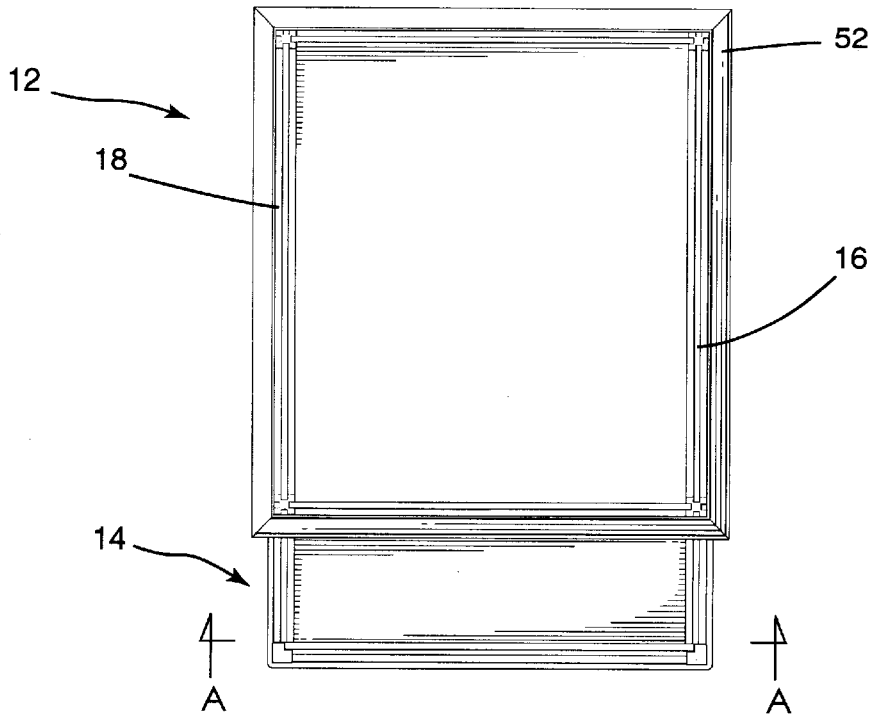
FIG. 2 is a top plan view thereof.
Figure 3:
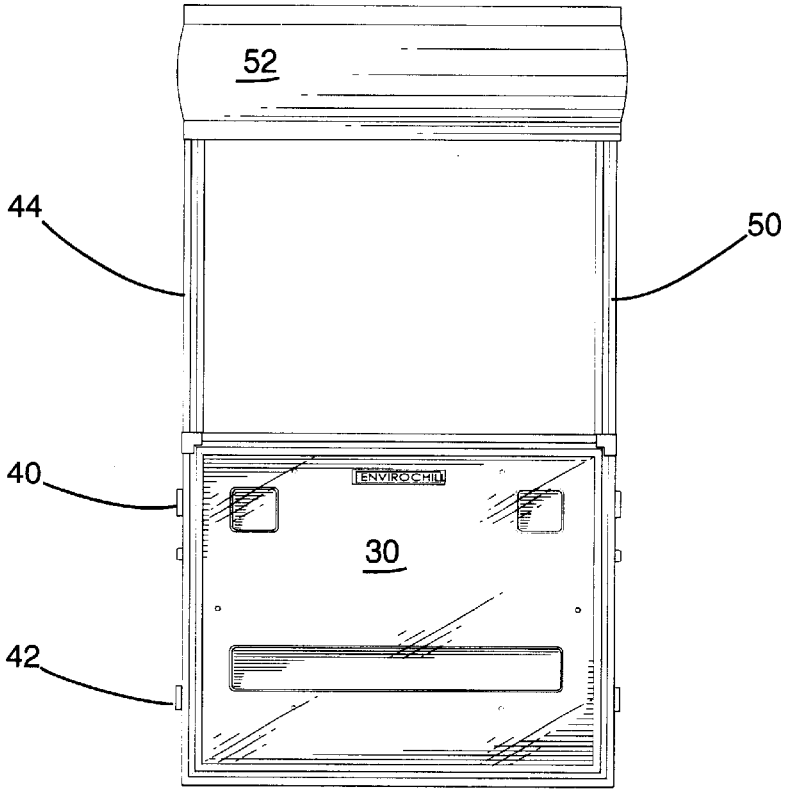
FIG. 3 is an end plan view thereof as seen from the top of FIG. 2.
Figure 4:
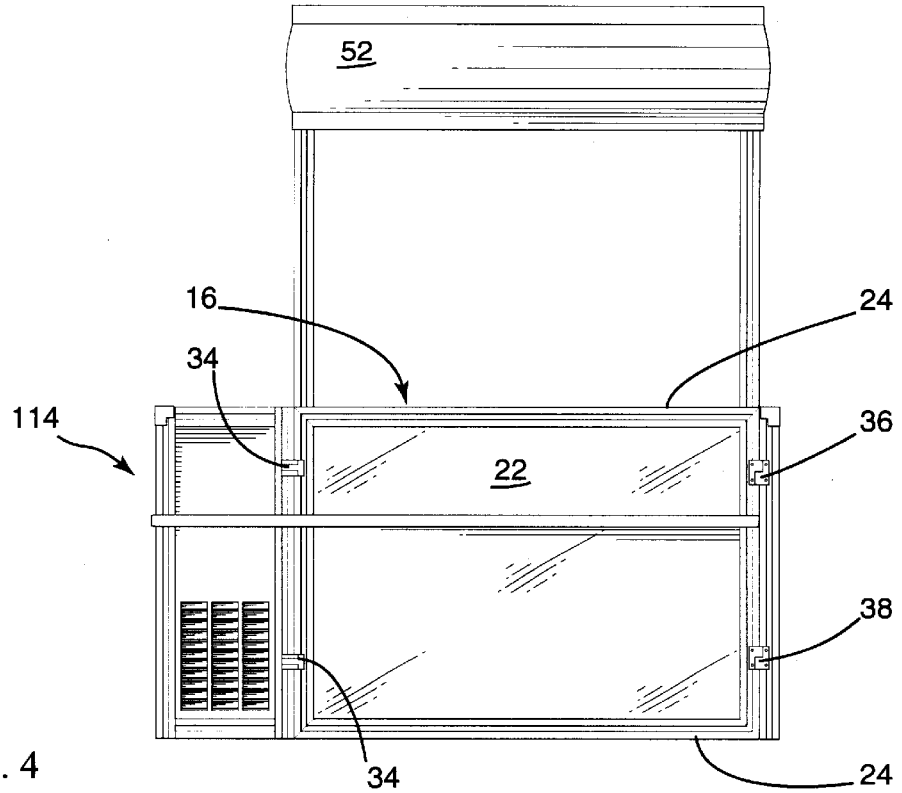
FIG. 4 is a side elevational view as seen from the right hand side of FIG. 2.
Figure 5:
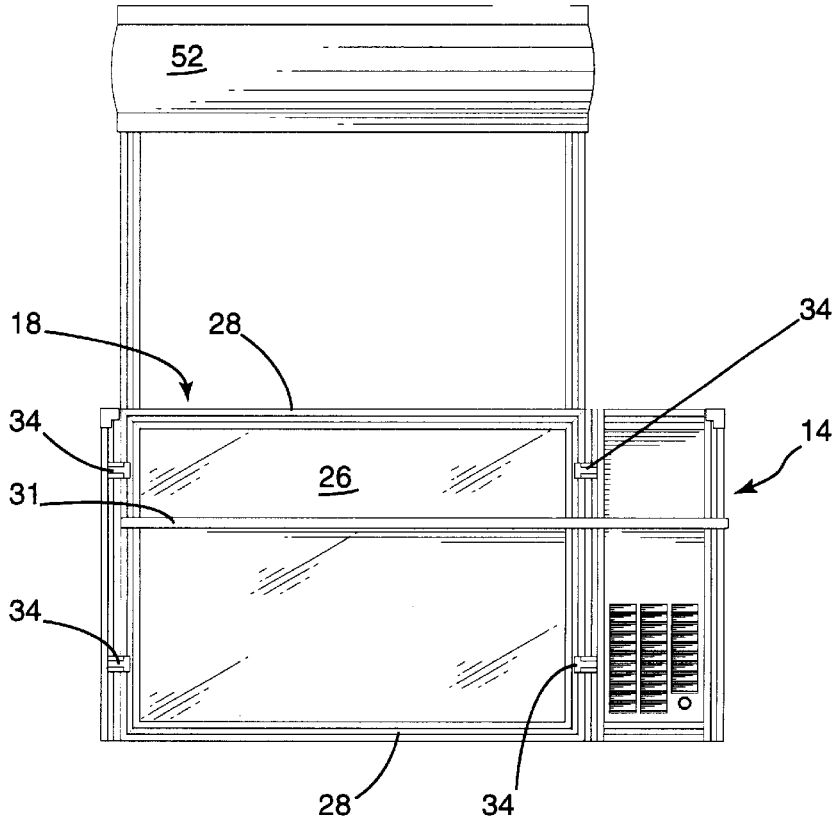
FIG. 5 is a side elevational view as seen from the left hand side of FIG. 2.
Figure 6:
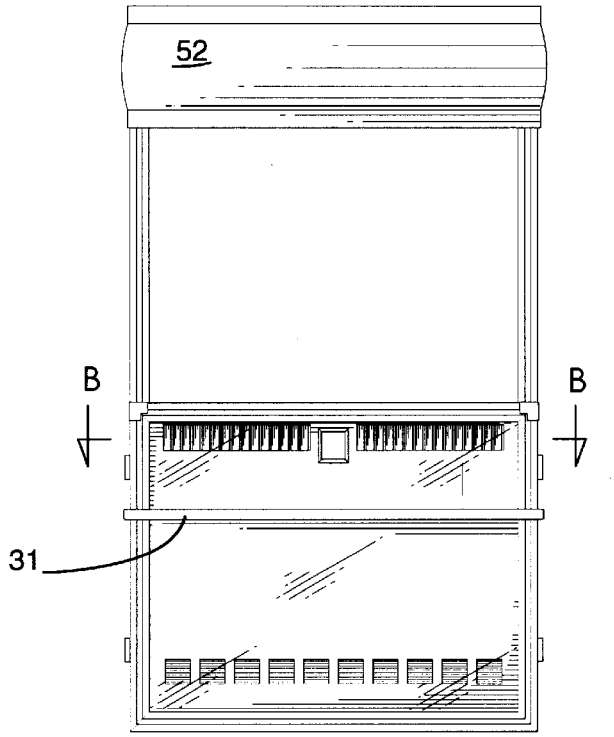
FIG. 6 is an end elevational view as seen from the bottom of FIG. 2.

Referring to the drawings in greater detail and by reference characters thereto, there is illustrated a transportable refrigerated display system generally designated by reference numeral 10.

Transportable refrigerated display system 10 includes a storage and display unit which is generally designated by reference numeral 12 and a refrigeration unit generally designated by reference numeral 14.

Storage and display unit 12 has a first side panel 16, a second side panel 18 parallel thereto, and an end panel 20.

Side panel 16 is comprised of a central transparent glass panel portion 22 with glass framing elements 24 extending thereabout. Similarly, side panel 18 is comprised of a glass panel 26 and glass framing elements 28 extending thereabout; glass panel 30 and glass framing elements 32 also form end panel 20.

Releasable connectors 34 are used for connecting side panels 16, 18 and end panel 20 together except for an upper hinge 36 and a lower hinge 38 associated with glass framing elements 24 of side panel 16 and an upper hinge 40 and a lower hinge 42 associated with glass framing elements 32 of end panel 20. As is seen, end panel 20 is hingedly connected to side panel 16.

Extending upwardly from the four corners of storage and display unit 12 and secured thereto are comer posts 44, 46, 48 and 50; between any two adjacent posts there may be placed display panels 52 to provide promotional information.

Refrigeration unit 14 is designed to fit at the distal ends of side panels 16 and 18 to thereby form an end panel for storage and display unit 12.

Refrigeration unit 14 includes an end wall 64 having insulation 66 formed therewith. End wall 64 also has an upper grill opening 68 and a lower grill opening 70. Refrigeration unit 14 also includes side walls 72 and 76 each having insulation 74 and 78 respectively associated therewith. Side wall 72 has a lower grill 75 formed therein.

A refrigeration unit end wall 80 is opposed to end wall 64 and likewise includes insulation 82. Bumpers 31 extend horizontally about the side and end walls.

Extending between the end walls 64, 80 and side walls 72, 76 is a base 84 which has a rubber seal 86 extending thereabout.

Mounted within refrigeration unit 14 is a condensing unit 88 and an associated electrical box 90. Coils 92 have capillary lines 94 and suction lines 96 extending to condensing unit 88.

Figure 11:
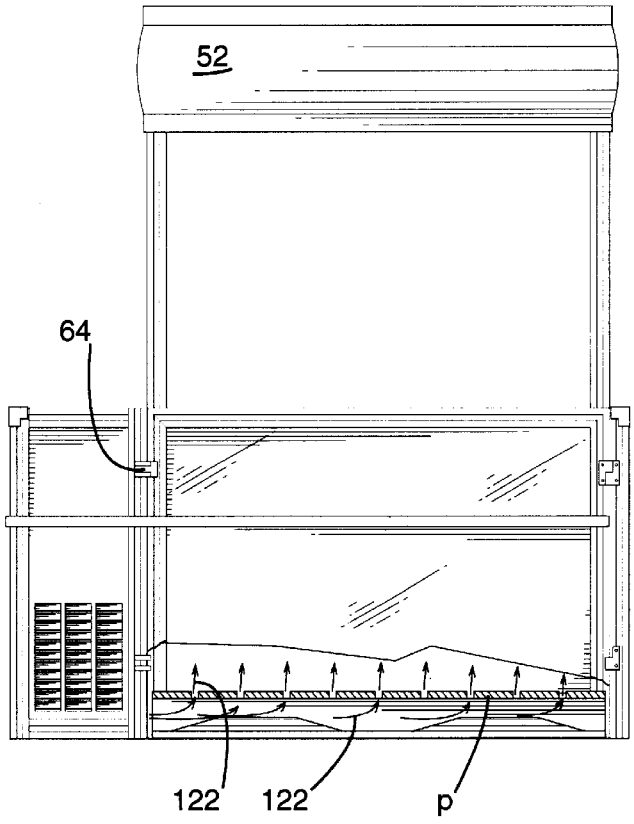
FIG. 11 is a side elevational view similar to FIG. 4 illustrating the movement of the cooling gases in the display unit.
Figure 7:
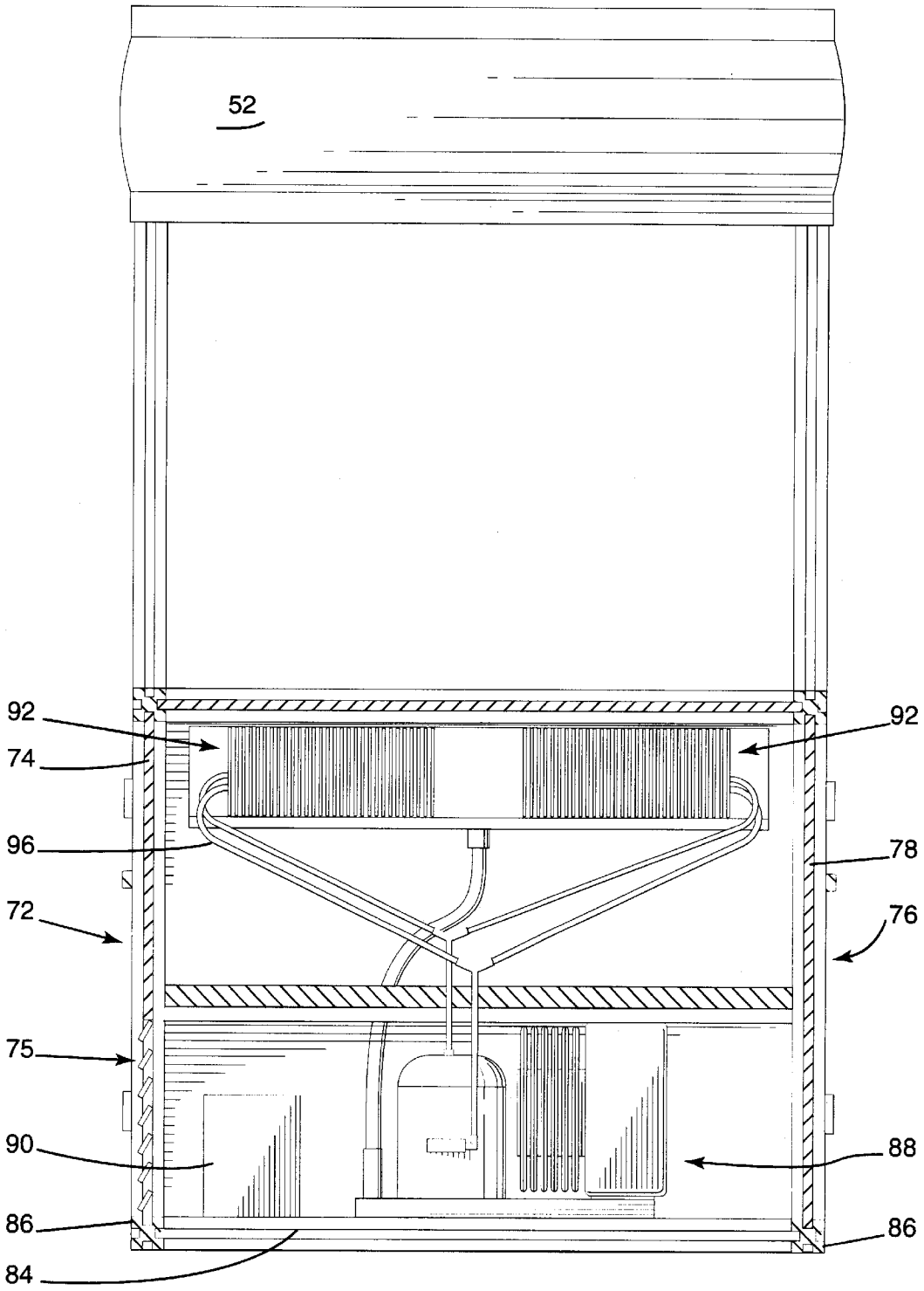
FIG. 7 is a cross sectional view taken along the line A—A of FIG. 2.

Fan 98 is mounted so as to continually circulate the air over coils 92 in the direction indicated by arrows 100 - i.e. the intake is through upper grill opening 68 and the cooled air exits through lower grill opening 70 into storage and display unit 12 where the cooled air circulates under a pallet P stored therein as indicated by arrows 122 in FIG. 11.

Figure 8:
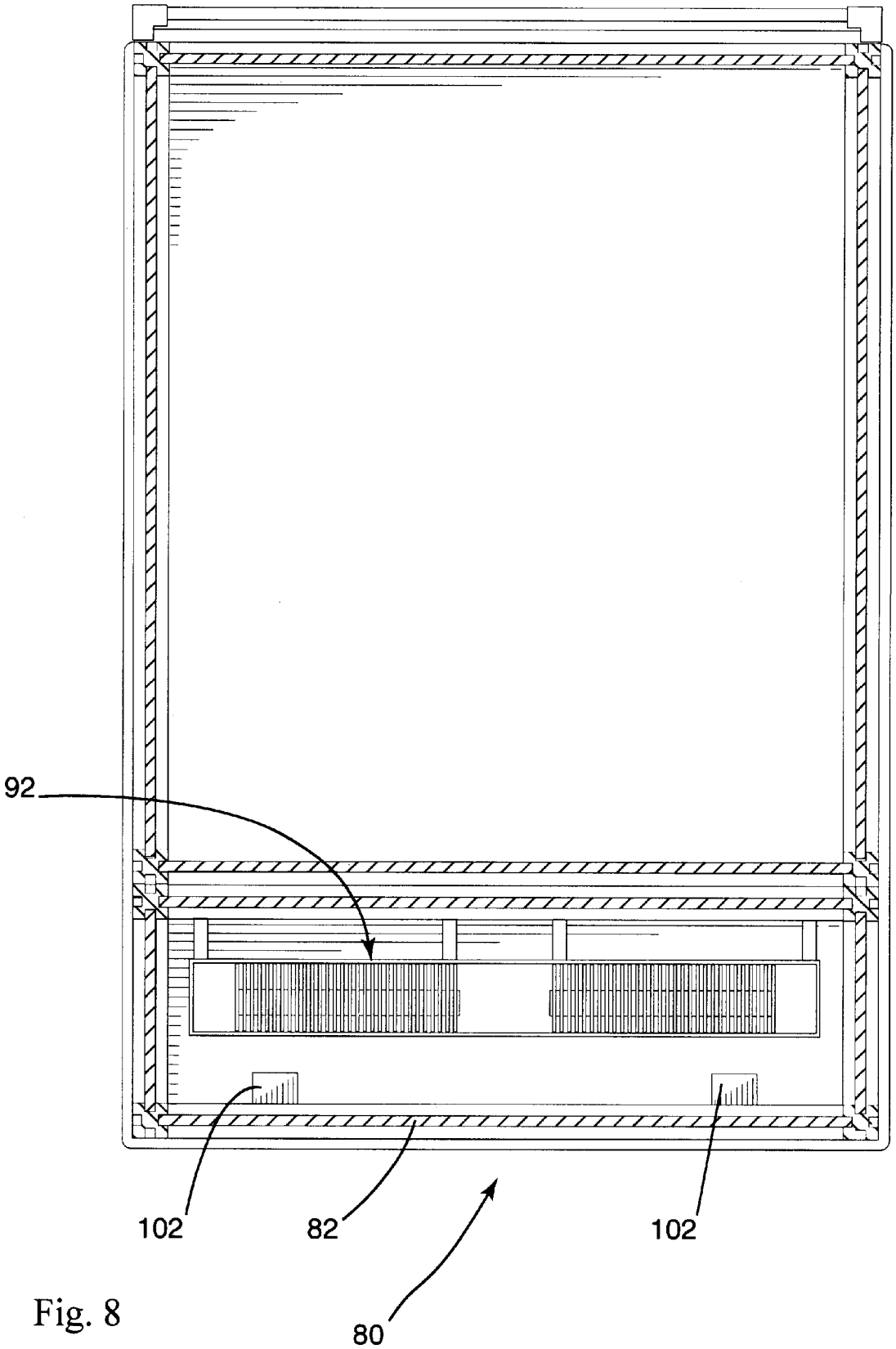
FIG. 8 is a sectional view taken along the line B—B of FIG. 6.
Figure 9:
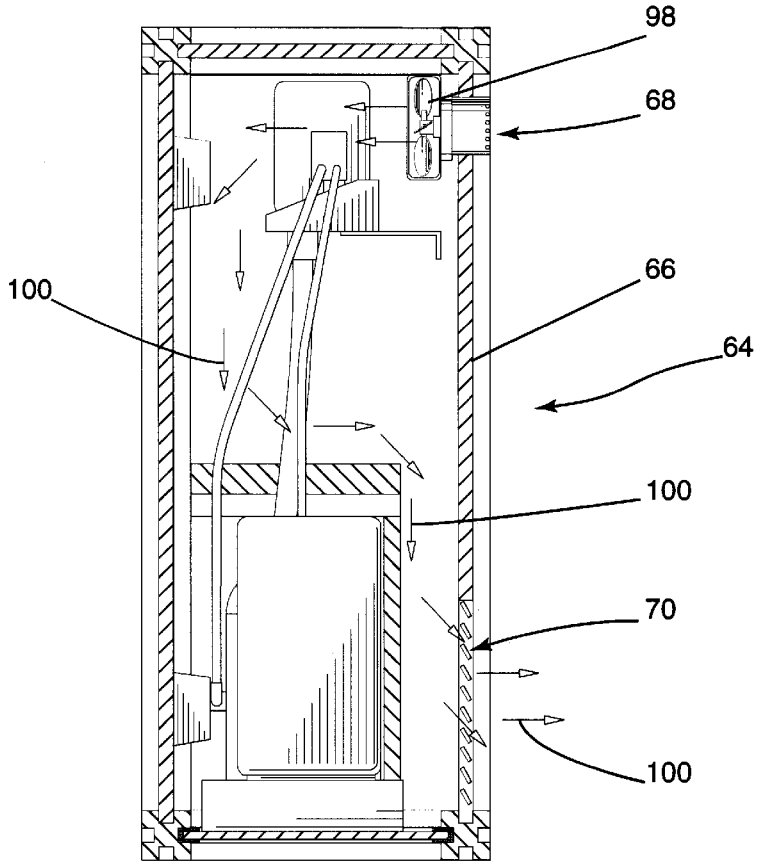
FIG. 9 is a cross sectional view of the refrigeration unit as seen from the side.
Figure 10:
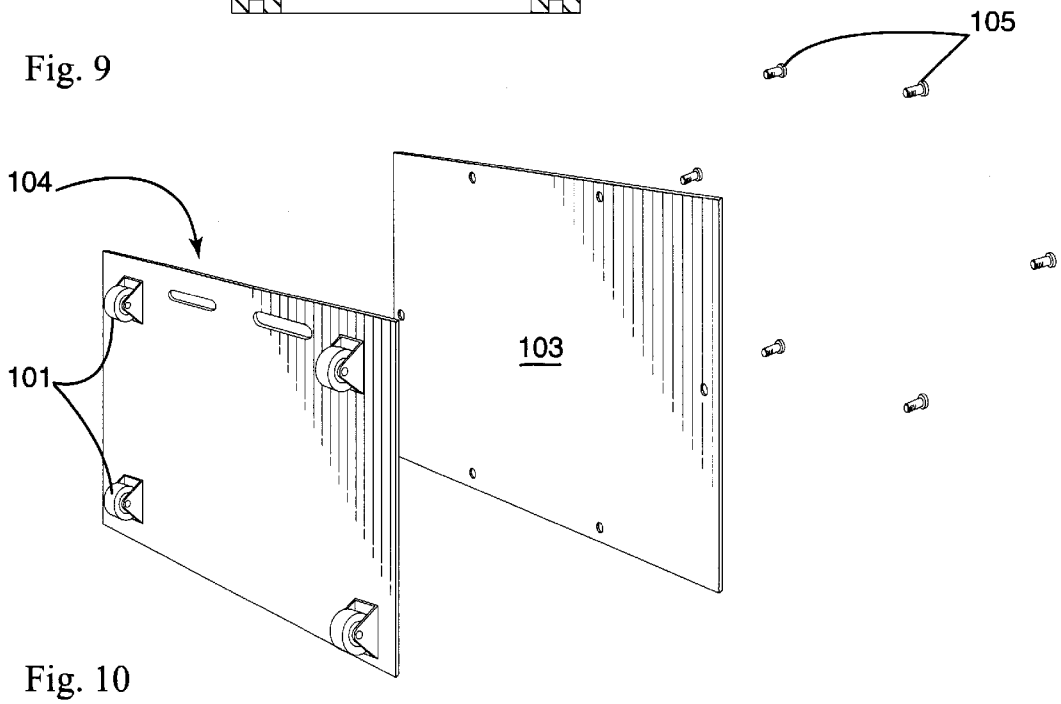
FIG. 10 is an exploded view of a cart and cover plate used with the display unit of the present invention.

As may be seen in FIG. 8, a pair of recesses 102 are formed in end wall 80. The recesses 102 and a lower portion of wall 80 are designed to accept the wheels 101 of a cart 104 (FIG. 9) designed for transporting the device. Cart 104 may be retained in place by means of an end panel 103 and screws 105.

It will be understood that the above described embodiment is for purposes of illustration only and that changes and modifications may be made thereto without departing from the spirit and scope of the invention.

I claim:

1. A refrigerated display system comprising a display unit and a refrigeration unit, said refrigeration unit comprising cooling means for cooling air, a refrigeration unit end wall having an upper air inlet and a lower air outlet, circulation means arranged to circulate cooled air from said cooling means through said lower air outlet and to receive air from said upper air inlet, said display unit comprising first and second side walls extending from said end wall of said refrigeration unit, a display unit end wall extending between distal ends of said side walls, said display unit end wall being opposite said refrigeration unit end wall, said display unit having an open top to permit ready access thereto, the arrangement being such that said cooled air will be circulated under a pallet placed within said display unit.

2. The refrigerated display system of claim 1 wherein at least a portion of said display unit end wall and said side walls are transparent.

3. The refrigerated display system of claim 2 further including protective bumper means extending about an exterior portion of said display unit end and side walls.

4. The refrigerated display system of claim 1 wherein said cooling means comprises a compressor, condenser coils, and evaporator coils, said refrigeration unit being a substantially enclosed chamber having means for circulating air past said compressor.

5. The refrigerated display system of claim 1 wherein one of said walls of said display unit is hingedly connected.

6. The refrigerated display system of claim 5 wherein said one wall is said display unit end wall.

7. The refrigerated display system of claim 1 further including a wheeled cart and wherein said refrigeration unit includes means for storing said wheeled cart therein.

8. In combination, a refrigerated display system and a pallet having articles to be cooled placed thereon, said refrigerated display system comprising a display unit and a refrigeration unit, said refrigeration unit comprising cooling means for cooling air, a refrigeration unit end wall having an upper air inlet and a lower air outlet, circulation means arranged to circulate cooled air from said cooling means through said lower air outlet and to receive air from said upper air inlet, said display unit comprising first and second side walls extending from said end wall of said refrigeration unit, a display unit end wall extending between distal ends of said side walls, said display unit end wall being opposite said refrigeration unit end wall, said pallet being placed within said display unit, the arrangement being such that said cooled air will be circulated from said lower outlet under said pallet placed within said display unit.

9. The refrigerated display system of claim 8 wherein at least a portion of said display unit end wall and said side walls are transparent.

10. The refrigerated display system of claim 9 further including protective bumper means extending about an exterior portion of said display unit end and side walls.

11. The refrigerated display system of claim 8 wherein said cooling means comprises a compressor, condenser coils, and evaporator coils, said refrigeration unit being a substantially enclosed chamber having means for circulating air past said compressor.

* * * * *